US011926357B2

(12) United States Patent
Hogg et al.

(10) Patent No.: US 11,926,357 B2
(45) Date of Patent: Mar. 12, 2024

(54) TRANSPORT AND RAIL INFRASTRUCTURE MONITORING SYSTEM

(71) Applicant: Asiatic Innovations Pty Ltd, Brisbane (AU)

(72) Inventors: Peter Hamilton Hogg, Belmont (AU); Glenn Vivian, Braypark (AU)

(73) Assignee: Asiatic Innovations Pty Ltd, Brisbane (AU)

( * ) Notice: Subject to any disclaimer, the term of this patent is extended or adjusted under 35 U.S.C. 154(b) by 481 days.

(21) Appl. No.: 17/312,684

(22) PCT Filed: Dec. 13, 2019

(86) PCT No.: PCT/AU2019/051369

§ 371 (c)(1),
(2) Date: Jun. 10, 2021

(87) PCT Pub. No.: WO2020/118373

PCT Pub. Date: Jun. 18, 2020

(65) Prior Publication Data

US 2022/0063690 A1 Mar. 3, 2022

(30) Foreign Application Priority Data

Dec. 13, 2018 (AU) ..... 2018904739

(51) Int. Cl.
*B61L 27/57* (2022.01)
*B61L 15/00* (2006.01)
(Continued)

(52) U.S. Cl.
CPC ..... *B61L 27/57* (2022.01); *B61L 15/0072* (2013.01); *B61L 15/0081* (2013.01);
(Continued)

(58) Field of Classification Search
CPC ..... B61L 27/57; B61L 27/53; B61L 27/40; B61L 15/0072
(Continued)

(56) References Cited

U.S. PATENT DOCUMENTS 5,203,089 A * 4/1993 Trefouel ..... B61K 9/08 33/651.1
5,353,512 A * 10/1994 Theurer ..... G01B 11/026 33/651.1
(Continued)

FOREIGN PATENT DOCUMENTS

AU 2005237656 11/2005
AU 2012204057 7/2012

*Primary Examiner* — George B Bennett
(74) *Attorney, Agent, or Firm* — Bonini IP Law, LLC; Frank J. Bonini, Jr.

(57) ABSTRACT

A rail infrastructure monitoring system enables integrated continuous monitoring and analysis of above and below rail assets, providing passenger and freight operators an end-to-end solution. Embodiments of the system comprise monitoring, coordinator control and display, communications, and business integration. Modern rail and transport techniques of providing integrated logistics are supported, offering improved safety, reduced total cost of ownership and the ability to increase capacity. Also, identification of links between different sets of data in 'real time' across all monitored infrastructure is enabled. Field hardware includes three modules: control; wagon master; and sensor, the latter communicating wirelessly with a wagon master module, and each sensor module is associated with a respective wagon or portion of below rail infrastructure. Sensor data values indicate the condition of either values outside the threshold alert of a train master via wagon master units or for below rail directly to the train master, which is then forwarded to a business component.

31 Claims, 13 Drawing Sheets

(51) Int. Cl.

| | |
|---|---|
| ***B61L 25/02*** | (2006.01) |
| ***B61L 27/40*** | (2022.01) |
| ***B61L 27/53*** | (2022.01) |
| ***B61L 27/70*** | (2022.01) |

(52) U.S. Cl.
CPC ..... *B61L 25/025* (2013.01); *B61L 27/40* (2022.01); *B61L 27/53* (2022.01); *B61L 27/70* (2022.01); *B61L 2205/04* (2013.01)

(58) Field of Classification Search
USPC ..... 33/1 Q, 523.1
See application file for complete search history.

(56) References Cited

U.S. PATENT DOCUMENTS

| | | | | |
|---|---|---|---|---|
| 5,986,579 | A * | 11/1999 | Halvorson | B61L 25/028 701/19 |
| 7,164,975 | B2 | 1/2007 | Bidaud | |
| 7,394,395 | B2 | 7/2008 | Sakatani et al. | |
| 9,581,998 | B2 * | 2/2017 | Cooper | G05D 1/0011 |
| 10,415,636 | B2 | 9/2019 | Sasao et al. | |
| 10,850,755 | B2 * | 12/2020 | Lefebvre | B61L 15/0027 |
| 11,148,689 | B2 * | 10/2021 | Worden | B61C 9/50 |
| 2002/0027495 | A1 | 3/2002 | Darby, Jr. et al. | |
| 2003/0107262 | A1 | 6/2003 | Smith et al. | |
| 2003/0183697 | A1 * | 10/2003 | Porter | B61L 25/028 235/492 |
| 2007/0208841 | A1 | 9/2007 | Barone et al. | |
| 2008/0195265 | A1 | 8/2008 | Searle et al. | |
| 2014/0129060 | A1 | 5/2014 | Cooper et al. | |
| 2016/0039439 | A1 | 2/2016 | Fahmy et al. | |
| 2016/0194014 | A1 | 7/2016 | Rajendran | |
| 2016/0359741 | A1 | 12/2016 | Cooper et al. | |
| 2021/0188336 | A1 * | 6/2021 | Seenumani | B61L 3/008 |
| 2022/0041194 | A1 * | 2/2022 | Lidgett | B61L 27/57 |
| 2023/0159069 | A1 * | 5/2023 | Brand | B61L 27/04 701/19 |

* cited by examiner

TRAIN MASTER BLOCK DIAGRAM

SENSOR BLOCK DIAGRAM

TRANSPORT AND RAIL INFRASTRUCTURE MONITORING SYSTEM

FIELD OF THE INVENTION

The present invention relates to a system and method of monitoring transport and rail infrastructure. In particular, although not exclusively, the invention relates to a system and method for monitoring and reporting on freight and passenger rail infrastructure by a plurality of sensor modules on above and below rail infrastructure. The invention supports the modern rail and transport techniques of providing integrated logistics, which in mining is known as a 'Pit to Port' concept.

BACKGROUND TO THE INVENTION

For rail monitoring systems, a rail operator typically installs various wayside detection systems from different manufacturers at fixed locations in a railway network. These locations are determined to facilitate the highest likelihood of detecting faults, and reduce the risk of having an incident, such as derailment. The systems are typically known as Asset Protection Systems and they function to monitor key parameters of the rolling stock and other rail infrastructure, and produce alarms if a performance indicator thereof is detected as going outside a pre-set or threshold level of performance.

The main problem with current wayside systems on the market is that they vary in reliability and do not monitor rail infrastructure, such as above rail (a train, e.g., Locomotives, wagons (freight and passenger), track machines, road-rail vehicles and other above rail infrastructure) and below rail (the railway infrastructure, e.g., track, formation, ballast, switches, signals, communications, power, level crossings, bridges), in a continuous or real-time manner. Both issues can result in missed detection of faults within rail infrastructure, which can result in incidents or accidents. Because of their stand-alone designs, current systems also are not capable of linking all data associated with each piece of infrastructure together so that cross data integration can occur.

Such wayside systems are also expensive to install and maintain. The major installation expense is determining a suitable location that is within easy reach of a power supply, a communications network and an access road, whilst sometimes trading this off against providing the best location to monitor the rail infrastructure. It is now common practice to co-locate the various wayside monitoring systems together to form a common installation site. This installation site allows for a more cost-effective utilisation of resources but there is inevitably a compromise, as some devices cannot be located together due to their design requirements. By way of example, a hunt detector generally needs to be close to a curve, whereas pantograph and acoustic bearing monitoring systems typically require a straight portion of railway track to function appropriately. In addition to the initial capital cost of the actual trackside monitoring system installation, the ongoing maintenance cost of these installations makes them very expensive to own and operate.

Further to the above, once an installation site has been chosen, there is usually a significant initial capital cost required, followed by ongoing maintenance costs of the installations themselves as well as the support systems, e.g., access roads, power systems and telecommunications systems. Additionally, there typically needs to be further preventative maintenance visits to protect, e.g., trackside cables during track tamping operations. Since the monitoring systems at such installation sites can only be located at a limited number of fixed locations, they can only detect a failure or fault at the location thereof, instead of when the failure or fault actually arises. As a result, if a critical or serious failure or fault occurs after the train in question has passed the installation site housing the monitoring systems (e.g., outside the detection window) but before the next installation site, then an accident or incident, such as derailment, could result.

Accordingly, there remains a need for an improved transport and rail infrastructure monitoring system.

OBJECT OF THE INVENTION

It is an object of the present invention to overcome and/or alleviate one or more of the disadvantages of the prior art or provide the consumer with a useful or commercial choice.

SUMMARY OF THE INVENTION

In one aspect, although not necessarily the only aspect or the broadest aspect, the invention is a rail infrastructure monitoring system, comprising:

- a control unit;
- a plurality of sensor modules configured to communicate wirelessly with a wagon master module, wherein each sensor module and each wagon master module are associated with a respective wagon of a train on a track, each sensor module including one or more sensor units, the sensor modules comprising:
  - a processor; and
  - one or a plurality of sensors adapted to measure one or more sensor data values indicative of a condition of a portion of the track infrastructure and/or the wagon, the sensors further adapted for inputting the sensor data values to the processor;
- wherein the processor is adapted to determine whether the measured sensor data values from the sensors is within a threshold range thereof and respond to a determination that the measured sensor data values are outside the threshold range by generating and sending an alert signal to the control unit.

In one embodiment, the sensor modules each include a unique identification address configured to associate the sensor data values with an identification number of a wagon or below rail infrastructure associated with the sensor module.

In certain embodiments, the sensors provide real-time and/or at least semi-continuous measurement of the sensor data values to the processor.

In some embodiments, the sensor modules each have a ZigBee transceiver and communicate locally with a wagon master module which then communicates (via its own separate ZigBee transceiver) with a train master control unit using wireless communications according to a ZigBee protocol. In other embodiments there is a LORA transceiver module or other modes of communications, or combinations thereof.

Suitably, the one or plurality of sensors are selected from the group consisting of a temperature sensor, an accelerometer, a vibration sensor, a gyroscope, a wind sensor, an acoustic sensor, a force sensor and any combination thereof.

The one or plurality of sensors are suitably operatively associated with a respective wheel axle assembly of the wagon.

In particular embodiments, the sensor data value is selected from the group consisting of a wheel temperature value, a brake block missing, a brake shoe wear outside limits, a dust value, a handbrake position, a Chute/Wagon cover position, a spring fault, a suspension range, a coupler force, slack value, a hunt detection, a brake air pressure, a train integrity status, a switch machine status, a bridge monitor, a track lubricator status, dangerous goods status, weather value, an axle vibration value, a bearing vibration value, a wagon weight, an acoustic signature and any combination thereof.

In one embodiment, the sensor data values are indicative of one or more of a degree of degradation of a bearing of a wheel, a flat portion on a wheel, a brake condition, an overloaded wagon, an unevenly loaded wagon, a chute/cover open, track temperature and wagon hunting.

Suitably, the wagon master modules each include a GPS unit and the sensor data values identify a respective location of each of the sensor modules and wagons.

In some embodiments, the wagon master modules are configured to communicate with a train master unit directly or by communicating through adjacent wagon master modules as intermediary communication links.

In particular embodiments, the control unit and/or the sensor modules are capable of receiving and/or processing one or more external signals from a below rail detection device.

Suitably, the system of the present aspect further includes a data transmitter for transmitting the sensor data values and/or the alert signals for all or at least a portion of the sensor modules to a control and/or an operator remote from the train. In the case of partial readings when the train comes back to high speed communication range or reaches the end of the journey any missing values are automatically downloaded to the control centre.

In another embodiment, the invention provides a wagon master module with various separate sensor modules for application to a wagon of a train on a track, each sensor module comprising:

- a transceiver configured to communicate wirelessly with the wagon master module;
- one or more sensor modules; the sensor modules comprising:
  - a processor; and
  - one or a plurality of sensors adapted to measure one or more sensor data values indicative of a condition of the wagon, the sensors further adapted for inputting the sensor data values to the processor;
- wherein the processor is adapted to determine whether the measured sensor data values from the sensors is within a threshold range thereof and respond to a determination that the measured sensor data values are outside the threshold range by generating and sending an alert signal to the wagon master module.

Suitably, the sensor module is suitable for use in the system of the aforementioned aspect.

In one embodiment, the wagon master module further comprises a unique identification address configured to associate the sensor data values with an identification number of the wagon or below rail infrastructure associated with the sensor module.

In particular embodiments, the sensors provide real-time and/or at least semi-continuous measurement of the sensor data values to the processor.

Suitably, the sensor modules and wagon master modules each have a ZigBee transceiver and communicate with their respective control units using wireless communications according to a ZigBee protocol. In other embodiments they may have another communications transceiver such as LORA, etc.

In certain embodiments, the one or plurality of sensors is selected from the group consisting of a temperature sensor, an accelerometer, a vibration sensor, a gyroscope, a wind sensor, an acoustic sensor, a force sensor and any combination thereof. Force sensor readings may be used to measure a number of things such as 'in train force", brake effectiveness and provide a feedback to the driver for driving strategy or into 'in cab' or 'Driverless' systems to provide dynamic adjustment of 'braking distance' and reduction of 'in train forces'.

The one or plurality of sensors are suitably to be operatively associated with a respective wheel axle assembly of the wagon.

In one embodiment, the sensor data value is selected from the group consisting of a wheel temperature value, a brake block missing, a brake shoe wear outside limits, a dust value, a handbrake position, a Chute/Wagon cover position, a spring fault, a suspension range, a coupler force, slack value, a hunt detection, a brake air pressure, a train integrity status, a switch machine status, a bridge monitor, a track lubricator status, dangerous goods status, weather value, an axle vibration value, a bearing vibration value, a wagon weight, an acoustic signature and any combination thereof.

In some embodiments, the sensor data values are indicative of one or more of a degree of degradation of a bearing of a wheel, a flat portion on a wheel, a brake condition, an overloaded wagon, an unevenly loaded wagon and wagon hunting.

Suitably, the wagon master module of the present aspect further includes a GPS unit and the sensor data values identifying a respective location of the sensor module.

In certain embodiments, the wagon master module is configured to communicate with the train master unit directly or by communicating through adjacent sensor or wagon master modules as intermediary communication links.

In one embodiment, the wagon master module is capable of receiving and/or processing one or more external signals from a below rail detection device.

In a further aspect, the invention resides in a method for monitoring a wagon of a train on a track, said method including the steps of:

- providing a wagon master unit and a sensor module, wherein the sensor module comprises a transceiver configured to communicate wirelessly with the wagon master unit and one or more sensor modules communicating with the wagon master unit, the sensor modules comprising a processor and one or a plurality of sensors;
- measuring by the one or plurality of sensors one or more sensor data values indicative of a condition of a portion of the track infrastructure and/or the wagon;
- inputting the sensor data values to the processor;
- determining by the processor whether the measured sensor data values from the sensors is within a threshold range thereof; and
- generating and sending an alert signal to the wagon master unit which then forwards the signal to the train master unit if the processor determines that the measured sensor data values are outside the threshold range.

Suitably, a train master unit is associated with a locomotive of the train.

In one embodiment, the present method further includes the step of receiving and/or processing one or more external signals from a below rail detection device.

In other embodiments, the present method further includes the step of associating the sensor data values with an identification number of the wagon or below rail infrastructure associated with the sensor module.

In some embodiments, the present method further includes the step of transmitting the sensor data values and/or the alert signals for all or at least a portion of the sensor modules (depending on communication and importance) to a control centre and/or an operator remote from the train. In the case of the partial readings when the train comes into hi speed communication range or reaches the end of the journey any missing values are automatically downloaded to the control centre.

In certain embodiments, the processor generates an alert signal if the sensor data values are above or below the threshold level.

Suitably, the sensor module is that of the aforementioned aspect.

Further features of the invention will become apparent from the detailed description below.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, in which.

DETAILED DESCRIPTION OF THE INVENTION

Figure 1:
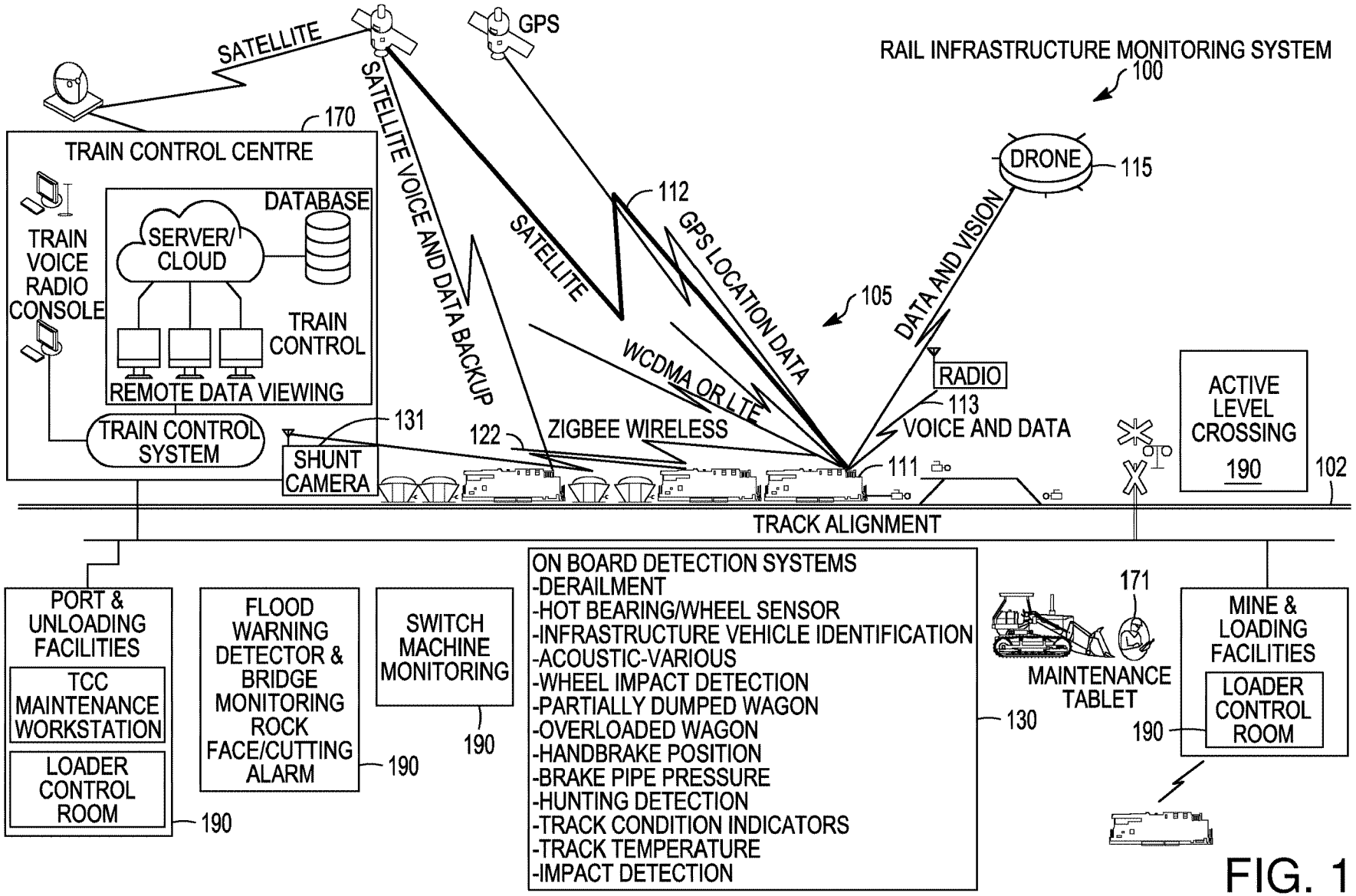
FIG. 1 is a schematic diagram of an embodiment of a complete rail infrastructure monitoring system of the present invention.

The present invention relates to a system and method for monitoring rail infrastructure, such as trains (i.e., above rail infrastructure) and one or more portions of a railway track (i.e., below rail infrastructure), and the performance and/or integrity thereof. Elements of the invention are illustrated in concise outline form in the drawings, showing only those specific details that are necessary to understand the embodiments of the present invention, but so as not to provide excessive detail that will be obvious to those of ordinary skill in the art in light of the present description.

Thus embodiments define a complete system of monitoring rail infrastructure that includes semi-continuous monitoring of indicators of the performance and/or integrity of rail infrastructure, inclusive of above rail infrastructure (e.g., rolling stock) and below rail infrastructure (e.g., railway track and associated infrastructure such as signalling, etc).

In this specification, adjectives such as first and second, top and bottom and the like may be used solely to distinguish one element or action from another element or action without necessarily requiring or implying any actual such relationship or order. Words such as "comprises" or "includes" are intended to define a non-exclusive inclusion, such that a method or apparatus that comprises a list of elements does not include only those elements but may include other elements not expressly listed, including elements that are inherent to such a method or system.

A monitoring system is described herein that comprises a plurality of individual sensor modules or units, each of which is associated with an individual piece of infrastructure (e.g., above or below rail infrastructure) such as a wagon of a train. Generally above rail infrastructure includes all rolling stock items, whereas below rail infrastructure includes the track and associated infrastructure such as switch machines and trackside signals. Each sensor module generates and monitors respective sensor data representing one or more sensed or detected environmental parameters or conditions expressed by at least one value, and generates and transmits an alert signal, preferably using a limited-range wireless communications protocol, such as Bluetooth, LORA WIFI or ZigBee, to the operator of a locomotive and/or a central control centre if this sensor data indicates a fault or imminent failure. It will be appreciated, however, that wired means of transmitting such sensor data and/or alert signals as are known in the art are also envisaged.

Accordingly, according to some embodiments a rail infrastructure monitoring system includes:

a) monitoring components (such as above and below rail sensors)

b) a coordinator control and display component (such as a train master module);

c) a communications component (such as along the train as well as moving along the track), and d) a business integration component.

Functionally the above provides a complete rail infrastructure monitoring solution by integrating monitoring and analysis of all above and below rail assets, including business integration.

The monitoring components can include a wagon master control unit and a plurality of sensor modules configured to communicate wirelessly with the wagon master which then communicate via each other to the train master unit, wherein each sensor module is associated with a respective wagon of a train (above rail) on a track or a sensor associated with the track itself (below rail), each sensor module including one or more sensor sub-modules. The sensor sub-modules comprising:

a processor; and one or a plurality of sensors adapted to measure one or more sensor data values indicative of a condition of a portion of the track infrastructure and/or the wagon, the sensors further adapted for inputting the sensor data values to the processor;

wherein the processor is adapted to determine whether the measured sensor data values from the sensors is within a threshold range thereof and respond to a determination that the measured sensor data values are outside the threshold range by generating and sending an alert signal via the wagon master then onto the train master unit which then is sent to a train control module.

Embodiments of the present invention avoid the high installation costs of trackside detection systems and the costs of the associated underlying infrastructure (e.g., optic fibre/radio backbone networks, power systems etc) and provides a cost effective alternative system, as the communication and power system components are built into the system and remote access is not required.

Current monitoring systems rely on wayside equipment that is fixed to a specific location in the rail network, which limits the detection of faults in a train to these locations only. Advantageously, the present rail monitoring system is not limited or fixed to a particular location, but rather allows for at least semi-continuous or real-time monitoring of all above rail infrastructure, such as a train and all below rail infrastructure such as the railway track itself. This allows for the rapid and early detection and transmission of potential faults in a rail network to a user thereof, such as a driver or central control operator, thereby acting to minimise damage to associated rail infrastructure, inclusive of the train and railway track thereof, and prevent accidents, such as derailment. Particular embodiments of the present rail infrastructure monitoring system also advantageously require no wayside monitoring devices.

By way of example, if a problem or fault is detected or predicted, the present rail monitoring system can relay an alarm or alert from the train in question via a high-power communication link to a central monitoring station or centre. If time permits, a maintenance action can be scheduled. Alternatively, if failure or an accident (e.g., derailment) is estimated to be imminent, the train can be diverted or stopped before such an event occurs. Accordingly, the present monitoring system can not only save operating costs, but also improve safety of users of the associated rail infrastructure.

Additionally, normal industry practice is that each piece of rail infrastructure that represents a risk is monitored by various means, either automated, or via manual inspection systems. None of these individual monitoring systems, such as wayside monitoring systems, are linked or coupled to each other or those monitoring systems associated with the train itself. By way of example, track and bridge monitoring systems are not coupled to train systems that monitor wagon weight or suspension faults. Certain embodiments of the present invention, however, advantageously provide for the interface and integration between below rail monitoring systems and those above rail such as within the train itself. The end result is that an operator is provided with a complete real-time picture of the rail network as it operates with the monitored trains and their impact on related rail infrastructure. For example, the rail monitoring system allows for the monitoring, in real time, of the wagon or car as it passes over the bridge with the bridge monitoring system allowing for the first time a clear understanding of the effect of one monitored parameter on the other.

In particular embodiments, the present rail infrastructure monitoring system also advantageously provides track monitoring (below rail) in addition to monitoring of rolling stock component (above rail) of the rail infrastructure, resulting in continuous and up to date track inspections that prevent or minimise the risks associated with manual track inspections or monitoring especially as high traffic densities limit preventative maintenance track inspections.

Figure 2:
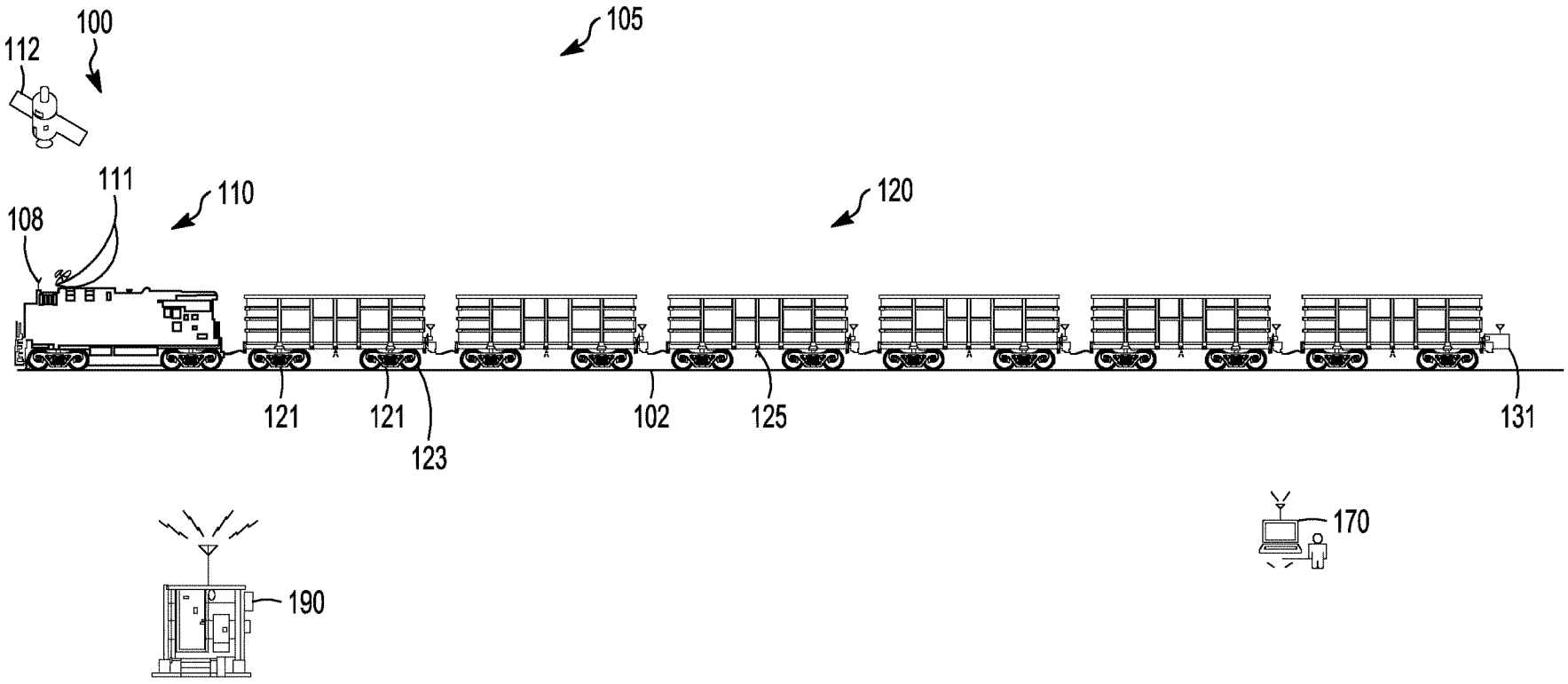
FIG. 2 illustrates a train that incorporates the rail monitoring system, according to the embodiment FIG. 1.
Figure 3:
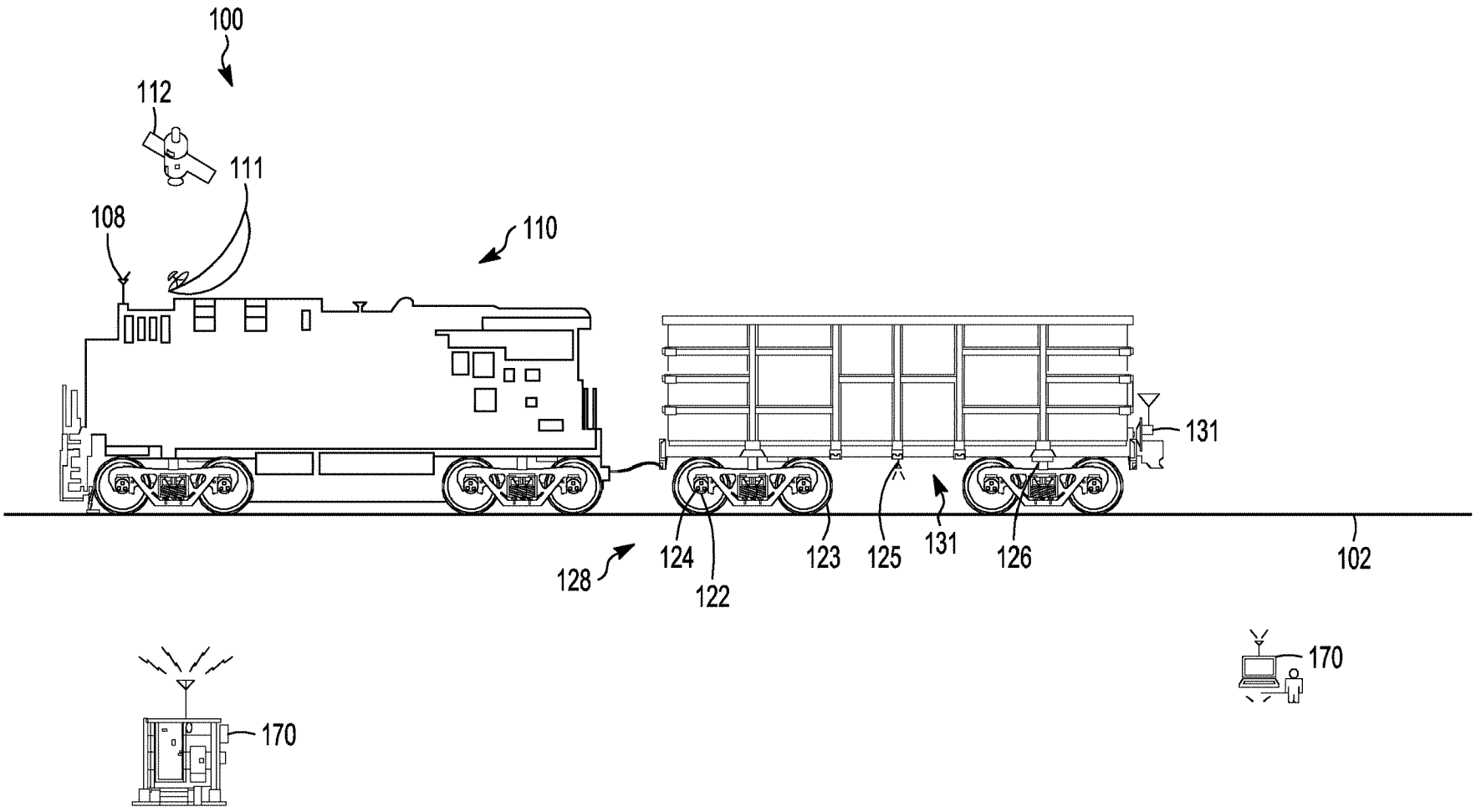
FIG. 3 provides a close-up view of a locomotive and a single wagon of the train of FIG. 2.

FIGS. 1, 2 and 3 provide an illustration of the rail infrastructure monitoring system 100, according to the invention applied in the context of a railroad train 105 on a railway track (i.e., below rail component) 102. The train 105 comprises a locomotive 110 and a plurality of serially connected railroad wagons or cars 120. Each wagon 120 is supported on two trucks or bogies 121, each having four wheels 123 and an associated bearing 124 and an axle 122 that together define a wheel axle assembly 128. Although the present rail monitoring system 100 is described below with respect to manually driven trains, it is envisaged that it can also be compatible with driverless train technology.

The rail infrastructure monitoring system 100 comprises onboard and self-contained diagnostic and monitoring sensor assemblies or sensor modules 126 having a plurality of sensors 130 that wirelessly communicate status and data to a wagon master module 125. The wagon master module 125 wirelessly communicates to an existing train master unit 108 that is located within the locomotive 110. Each wagon master module 125 of the rail infrastructure monitoring system 100 is associated with a single wagon 120.

Figure 5:
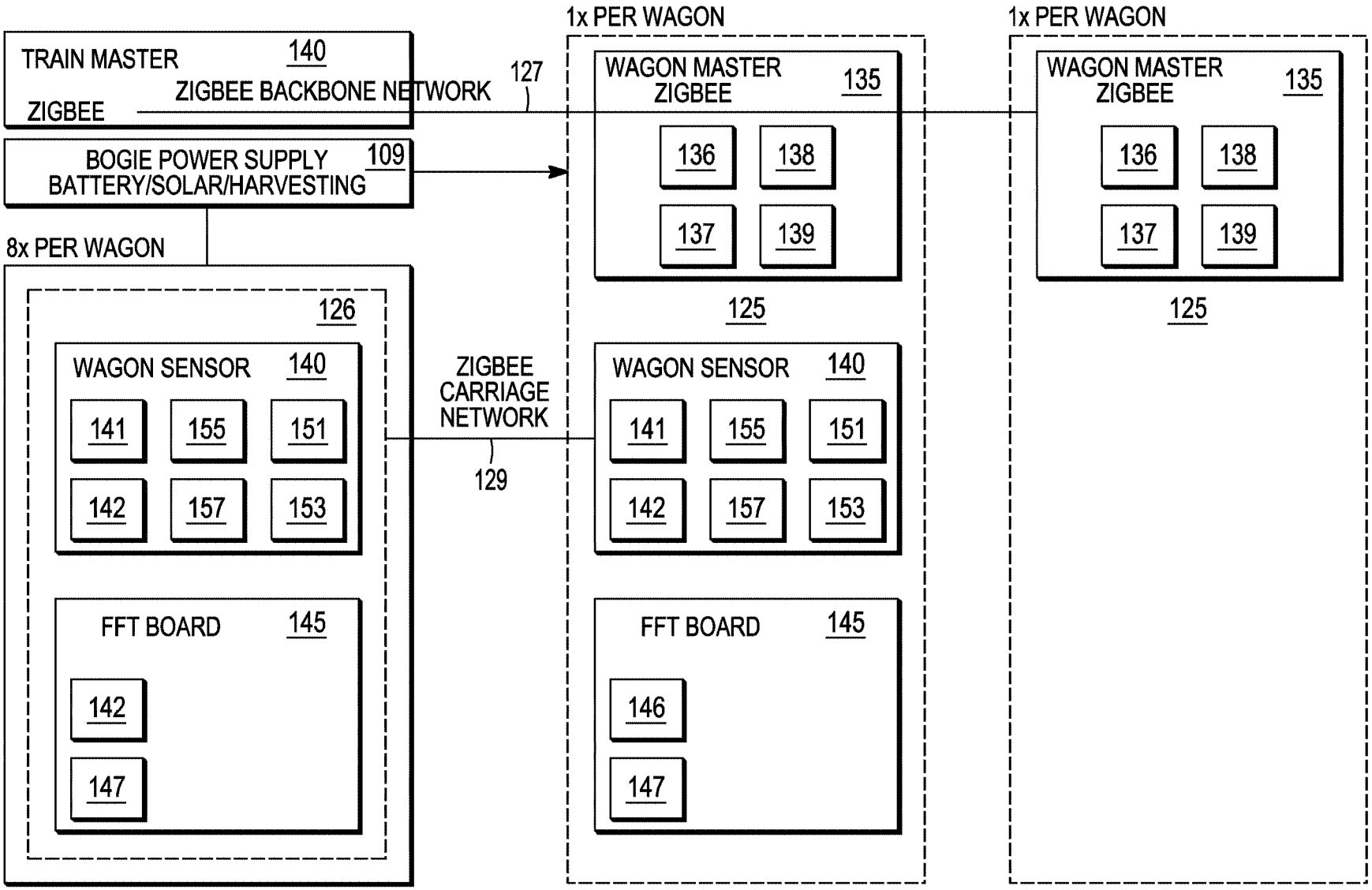
FIG. 5 is a schematic diagram of train master, wagon master and sensor modules of the complete rail infrastructure monitoring system of FIG. 1.
Figure 12:
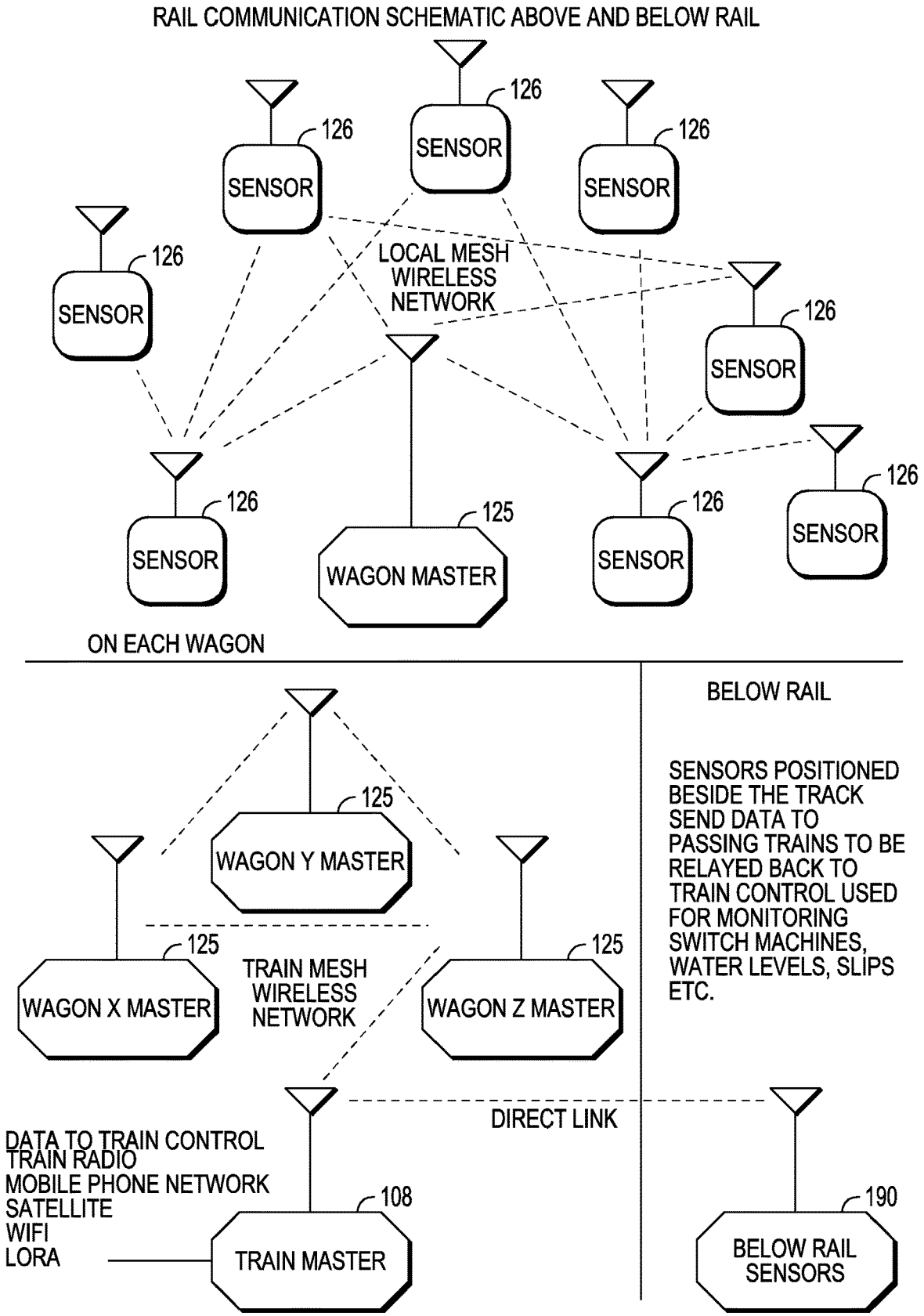
FIG. 12 provides a rail communication schematic.

The sensor modules 126 when powered, autonomously form a local intra-wagon network, as indicated schematically in FIG. 5 as line 129 (e.g., a ZigBee Carriage Network) and in FIG. 12 as a local mesh wireless network. The wagon master modules 125, when powered, each autonomously form an inter-wagon network, as described below and indicated schematically in FIG. 5 as line 127 and in FIG. 12 (e.g., a train mesh network), and wirelessly transmit status indicators and diagnostic data as required to the train master unit 108 of the locomotive 110, either by direct wireless communication the train master unit 108 (e.g., the train master unit 108 is or comprises a ZigBee radio-equipped computer system supported on and powered by the locomotive 110), or by a leap-frog or mesh network using the other master modules 125 by ZigBee communications to act as intermediaries to receive and forward communications to the train master unit 108 in the locomotive 110.

In the embodiments provided, the master modules 125 and/or the train master unit 108 can also receive one or more inputs from or interface with one or more below rail sensors, monitors or devices 190, as indicated in FIG. 1 and FIG. 12 as below rail infrastructure, as are known in the art. Non-limiting examples include a flood sensor, a rock face or embankment slip sensor or indicator, a wind monitor, a weather monitor, a switch machine monitor, a bridge monitor, a level crossing monitor, weather monitors including but not limited to stream flow detector (used where hydrology data suggests a risk of periodic water flow which could threaten integrity of the railway track 102 by overtopping bridges and the track formation). The wagon master module 125 shown in FIG. 6 has other sub-modules 140 and 145 installed, which function the same as an additional sensor module 126 to allow other monitoring to be undertaken, such as the below rail inputs described above.

The train master unit 108 in the locomotive 110 also suitably functions as the network coordinator. Powered by the locomotive's 110 onboard power system, it preferably transmits network beacons to the master modules 125, sets up the network of master modules 125, manages the networked operation, stores network module information, and routes messages, when appropriate, between paired master modules 125. Suitably, the train master unit 108 receives communications from each of the master modules 125 in at least a semi-continuous or real-time manner.

Additionally, the train master unit 108 can interface with an existing locomotive communication system 111. To this end, the locomotive 110 is configured for long-range communications, such as satellite communications 112 or mobile phone communications 113, and transmits via cell phone or satellite phone, or via a combination thereof, status indicators, alert signals and/or sensor data derived from one or more of the master modules 125 of the wagons 120 attached to the locomotive 110 to a control centre or system 170 remote therefrom. Additional modalities of wireless communication, such as ZigBee, WiFi, Bluetooth, VHF/UHF radio, LoRa and the like are also envisaged for the communication system 111. The locomotive 110 may also comprise, for example, an audible and/or visual alarm unit or system 107 (e.g., a speaker unit and/or a display) operably connected to the train master unit 108 so as to alert an operator therein of a particularly urgent alert or condition that may require the train 105 to be stopped or diverted immediately.

Figure 13:
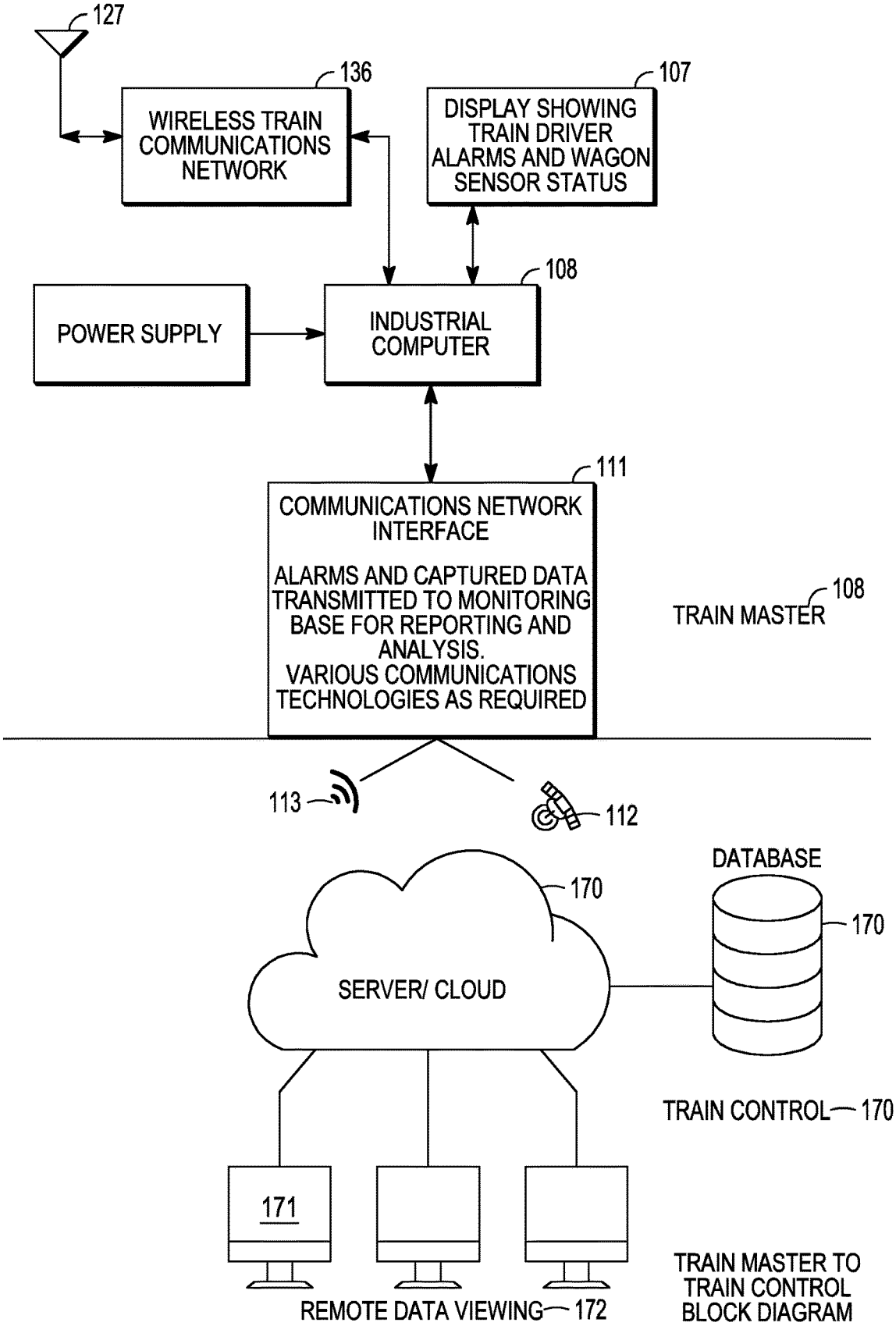
FIG. 13 provides a train master to train control block diagram.

The train master unit 108 is adapted to process and/or store the sensor data wirelessly received from each of the master modules 125 and displays reports of the sensor data to the operator in the locomotive 110 itself and/or the control centre 170 (see FIGS. 1 and 13). Such reports and sensor data may also be accessible to users having access to the rail monitoring system 100 via the Internet or other mobile communications systems, as are known in the art. Those mobile communications systems (e.g., a mobile or tablet device carried by a railroad worker 171) (see FIGS. 1 and 13) also preferably have a display for displaying data, input mechanisms for requesting information, and a speaker unit for broadcasting an audible alarm to alert the worker to an urgent alert or condition.

Figure 4:
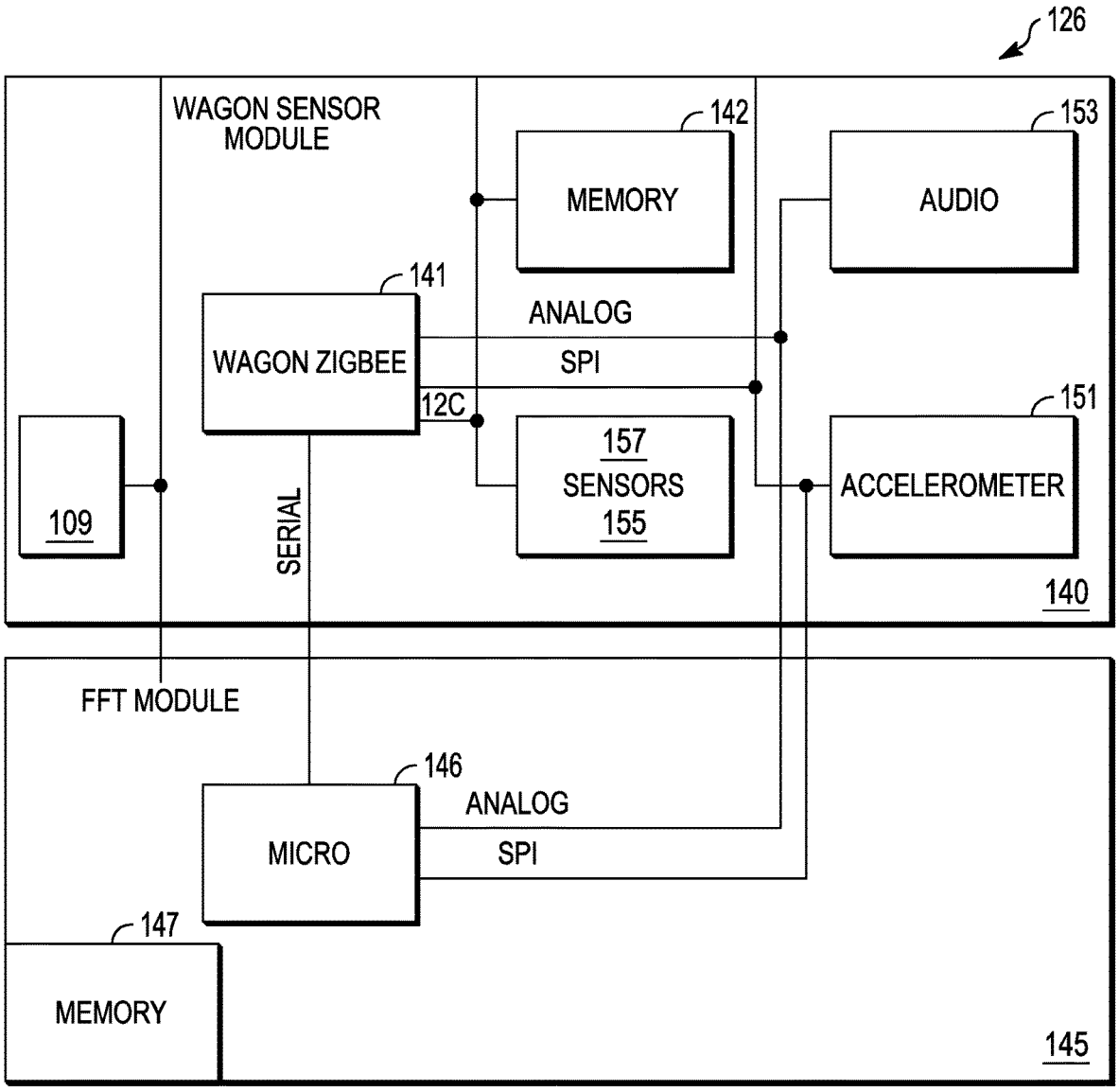
FIG. 4 is a schematic diagram of a sensor module of the complete rail infrastructure monitoring system of FIG. 1.

As illustrated in FIG. 4, the sensor modules 126 each comprise one or a plurality of monitoring devices or sensor sub-modules 140. Preferably, each sensor module 126 comprises the same or substantially the same number, arrangement and configuration of sensor sub-modules 140, but it will be appreciated that in alternative embodiments, each of the sensor modules 126 may contain one or more different sensor sub-modules 140 that may contain, for example, different sensors or different arrangements thereof. As shown in FIG. 3, the respective sensor modules 126 are positioned adjacent each wheel 123 of the wagon 120.

Figure 10:
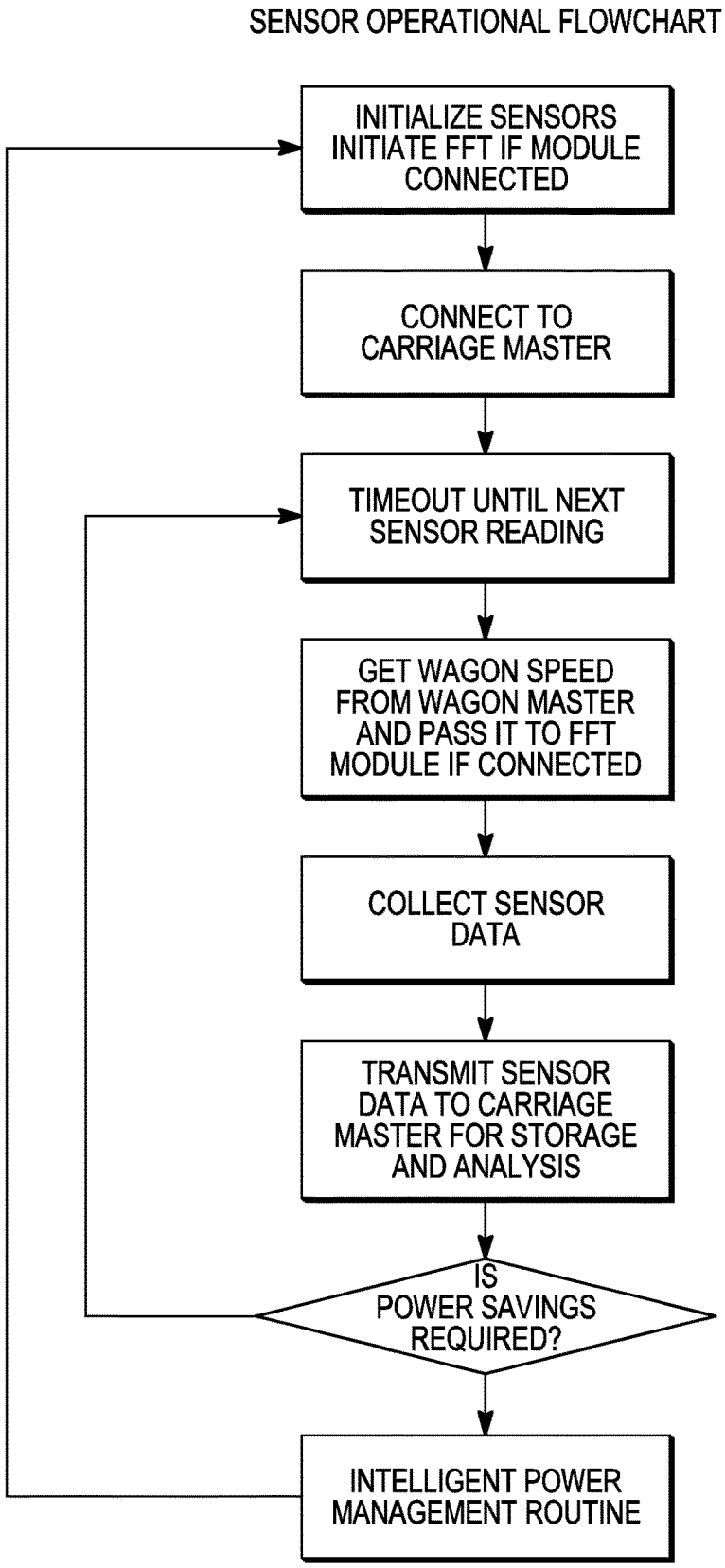
FIG. 10 provides a sensor operational flowchart.
Figure 11:
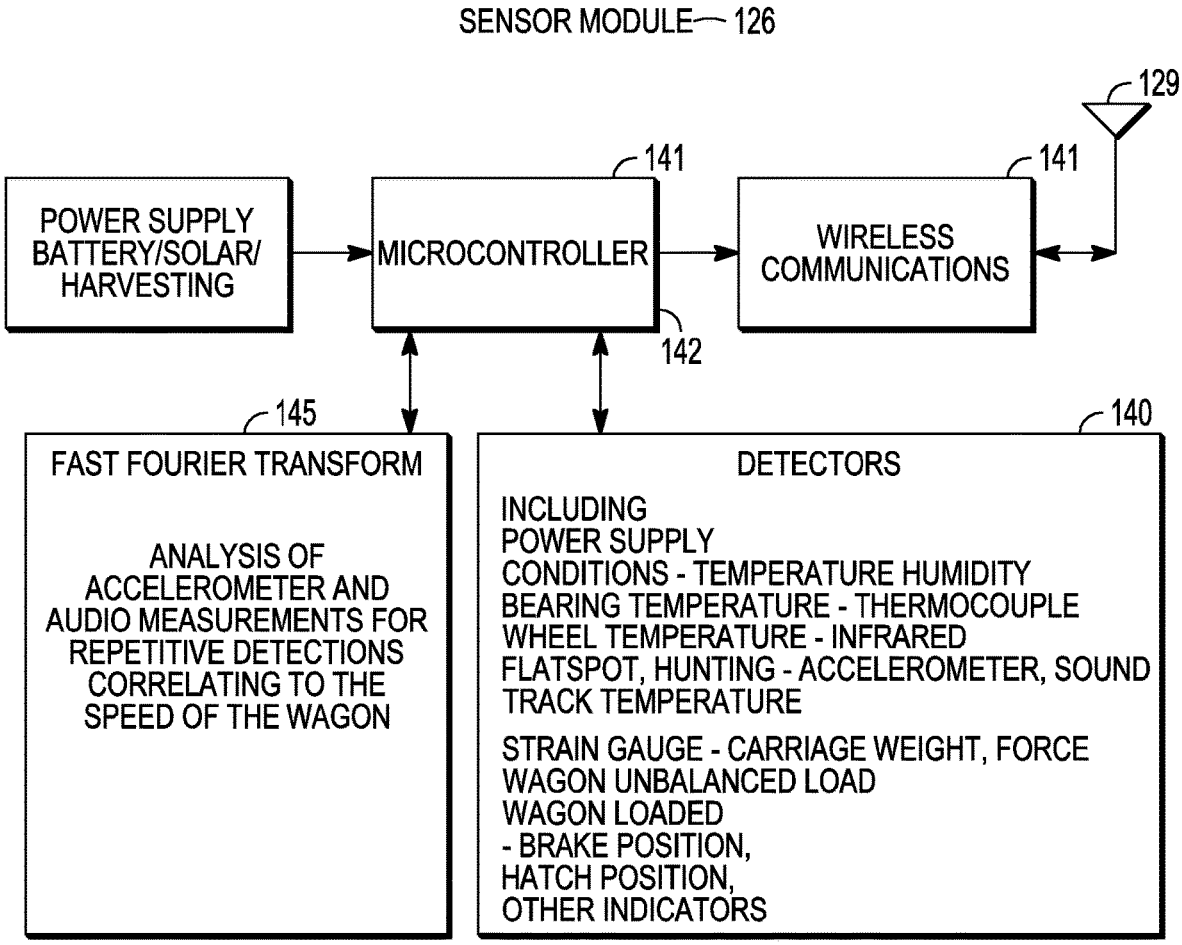
FIG. 11 provides a sensor module block diagram.

Each of the sensor sub-modules 140 are configured to detect or sense one or more performance indicators or environmental conditions or stimuli and thereby generate sensor data therefrom. A number of parameters may be used, including, for example, temperature, vibration, light, varying or constant magnetic or electrical fields, humidity, location (such as indicated by a GPS system or otherwise), acceleration, velocity, sound, shock, pressure, force or the flow rate of a fluid or a gas. As shown in FIGS. 4 and 5, the sensor modules 126 have sub-modules 140 which are each operably coupled to a respective data processing module 145, such as a Fast Fourier Transform (FFT) module with the option of further processing occurring in other modules as required, for processing the detected sensor data as outlined in more detail below. See FIG. 10 showing a sensor operational flowchart.

Referring to FIG. 5, each wagon master module 125 further includes a control or master sub-module 135, which is operably connected to the plurality of sensor sub-modules 140 and data processing sub-modules 145. Both the sensor module 126 and wagon master module 125 are also electrically coupled to a power supply 109, such as a battery, a generator, existing supply, energy harvester or a solar cell, which supplies power to each of the control sub-module 135, the sensor sub-modules 140 and the data processing sub-modules 145.

Figure 6:
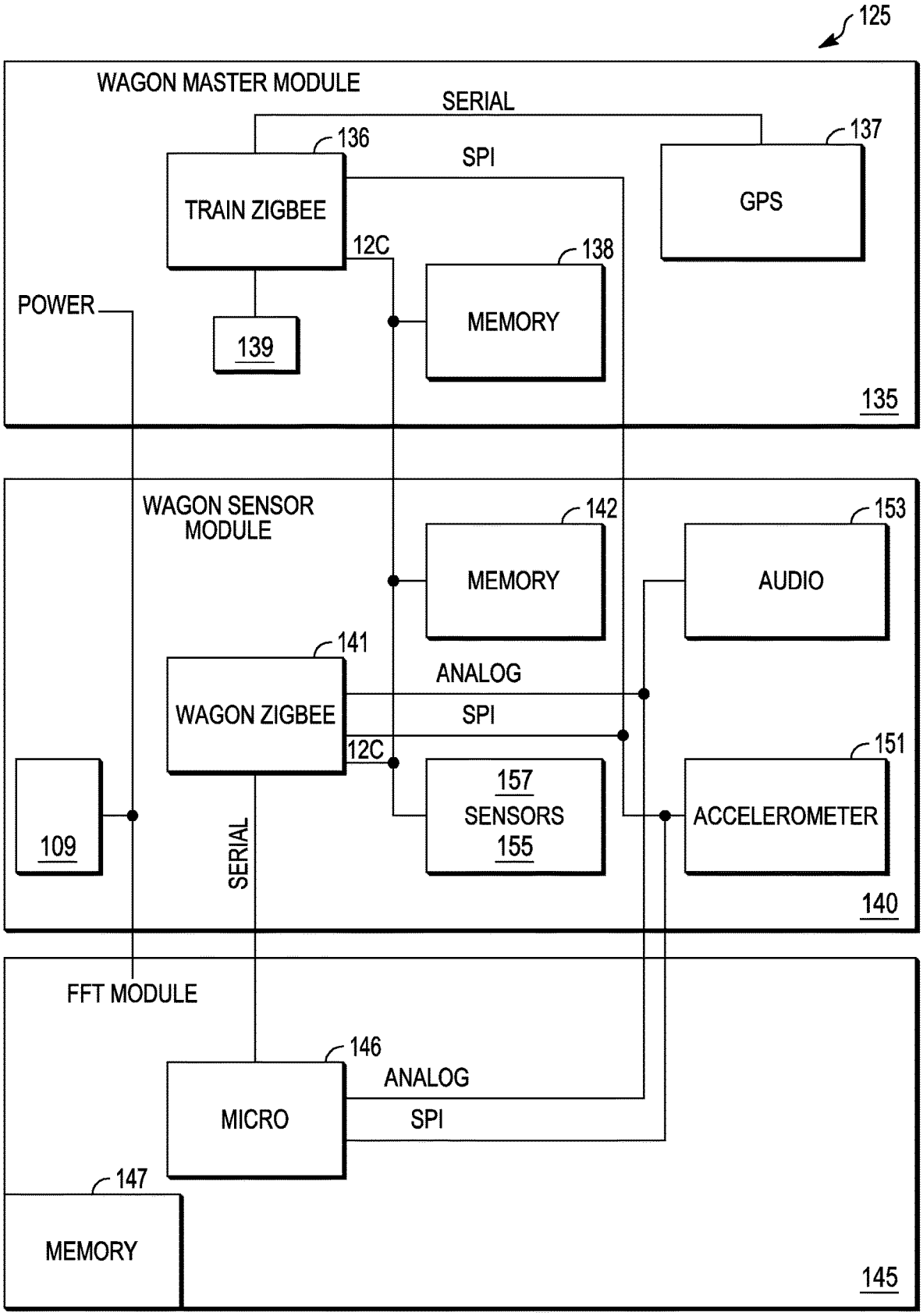
FIG. 6 is a general diagram of the functional components of a wagon master module of FIG. 5.
Figure 7:
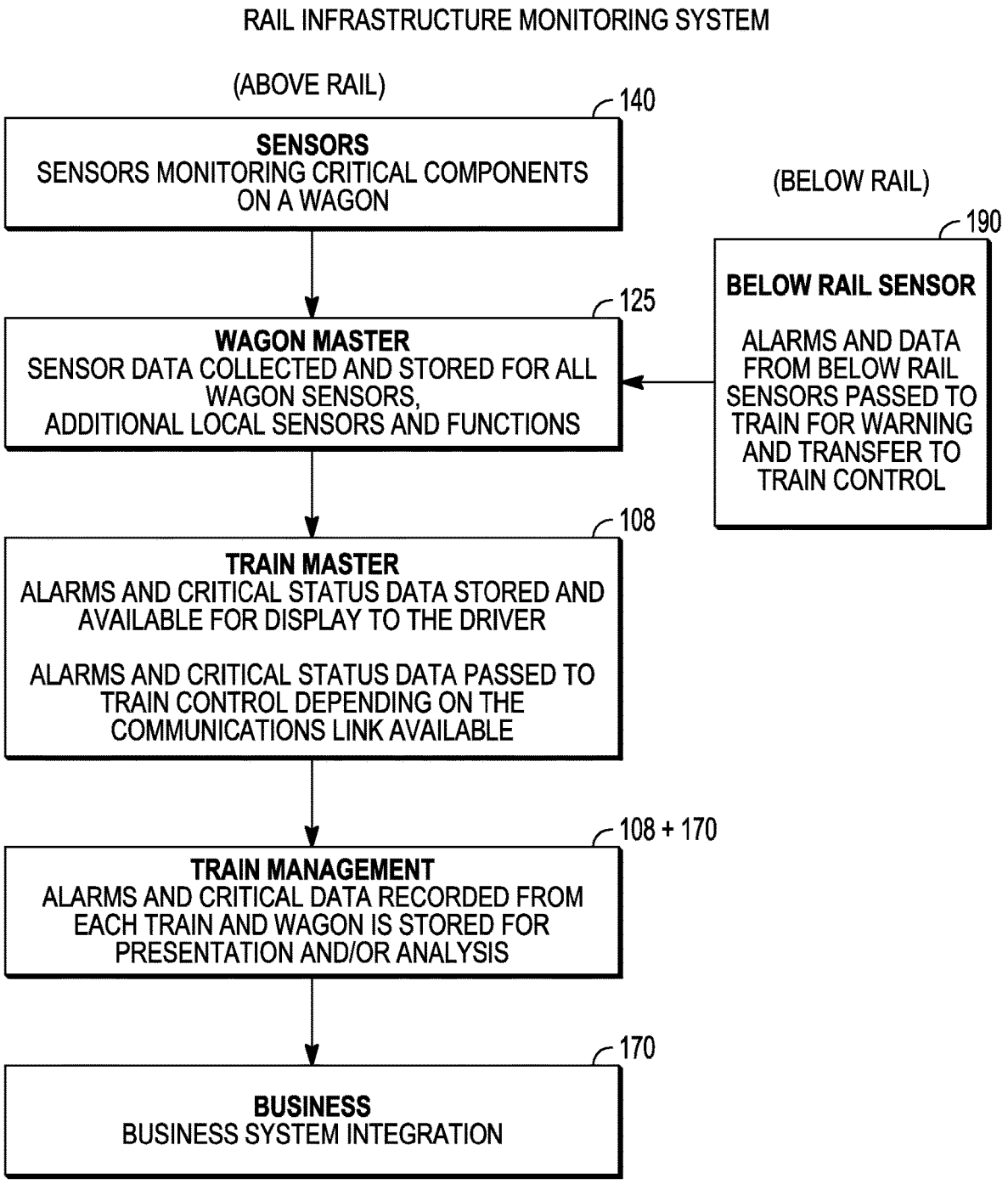
FIG. 7 provides an overview of a rail infrastructure monitoring system information flow.
Figure 8:
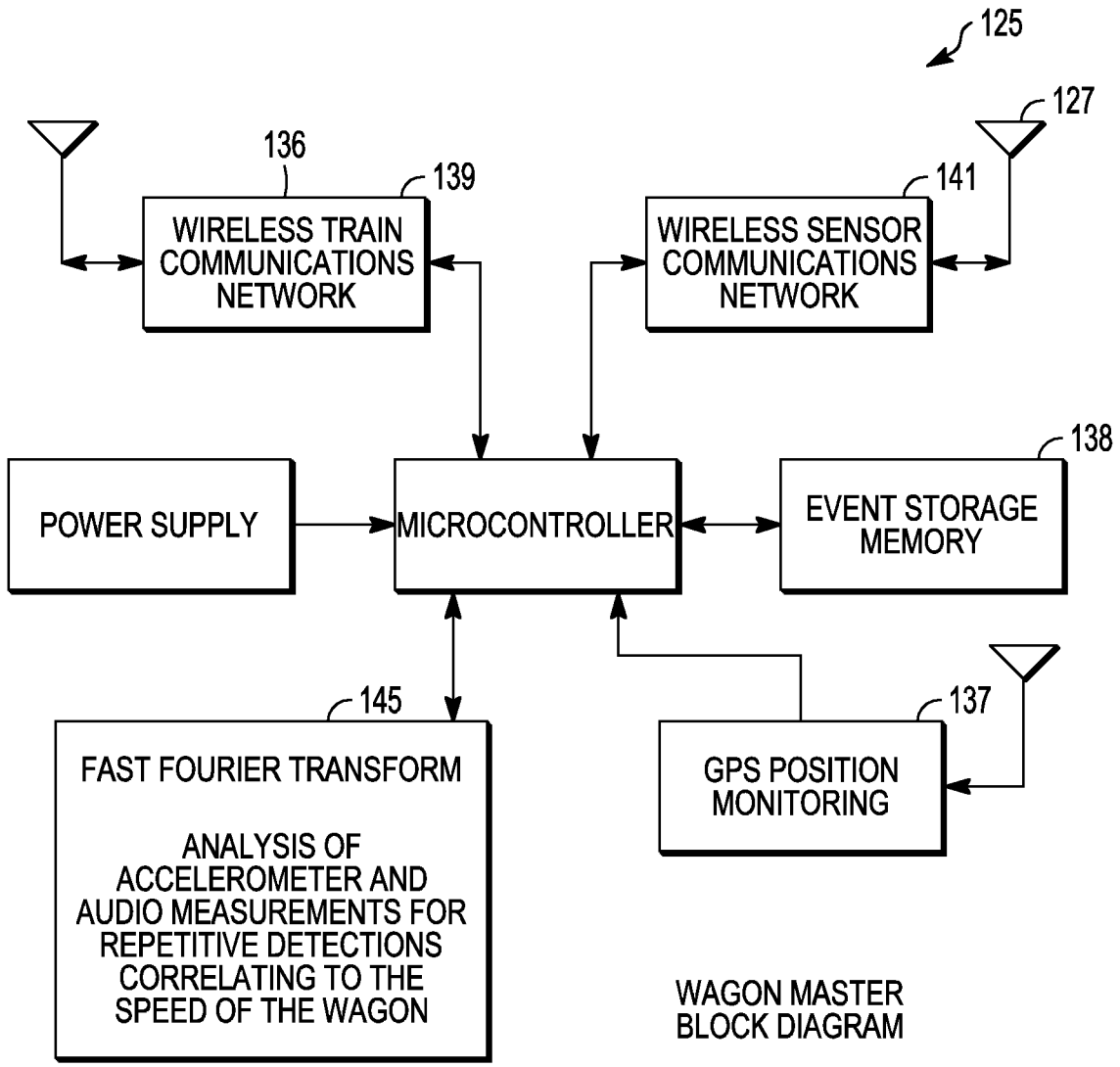
FIG. 8 provides a block diagram of a wagon master module.
Figure 9:
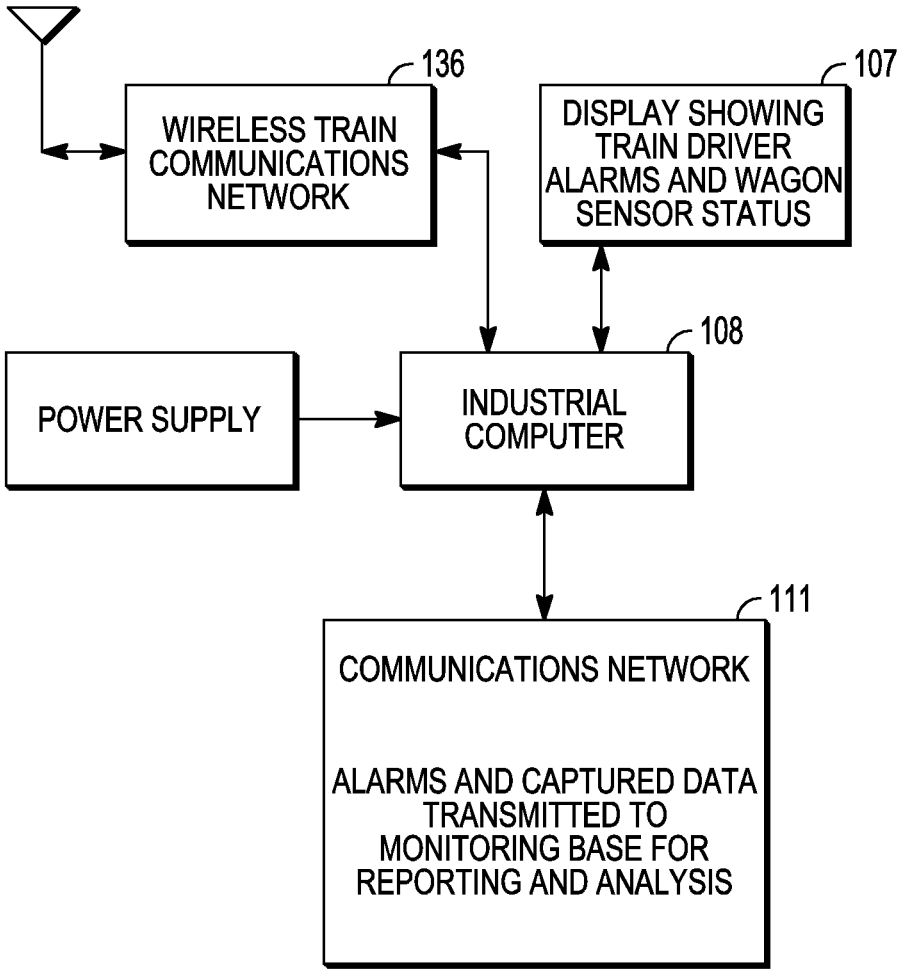
FIG. 9 provides a block diagram of a train master module.

Referring to FIGS. 5 and 6, in the wagon master module 125 the control sub-module 135 comprises a ZigBee transceiver 136 for operably connecting to the inter-wagon network 127. Further to this, a GPS unit 137 is incorporated into the control sub-module 135 which provides GPS position, date and/or time data with respect to a specific wagon 120 of the train 105. In particular embodiments, the GPS unit 137 of respective wagons 120 can be used to determine any slack action (e.g., slack "run in" and/or "run out") there between. Additionally, data from the GPS unit 137 can be used to determine an approximate length of a train 105. This information in conjunction with the number of associated wagons 120 of the train 105 and rear of train air pressure allows the system 100 to enhance the rail operators' safety requirement for train integrity.

Additionally, the wagon master control sub-module 135 includes a data storage unit 138, which may include, for example, a system memory, a non-volatile memory, a storage device or the like, as are known in the art. It would be appreciated that the event storage unit 138 may, for example, store data with respect to a threshold level as well as historical data of the functioning of the respective sensor modules 126. In particular embodiments, only sensor data that falls outside normal ranges (i.e., is outside one or more threshold levels) and hence stimulates the control sub-module 135 to generate an alert signal is to be stored in the data storage unit 138 for further analysis later.

The control sub-module 135 further incorporates a unique identification unit 139, which is configured to automatically associate sensor data with, for example, an identification number of the wagon 120 in question, as well as GPS position, time and date data and the like. This advantageously allows for sensor data and/or alert signals to be linked to the wagon 120 in question facilitating the rapid and pin point diagnosis of faults within a train 105. In particular embodiments, the sensor data that does not indicate a fault is still associated with the unique identification unit 139 and may or may not be transmitted wirelessly by the wagon master control module 135 to the train master unit 108 depending on operator requirements, though eventually all sensor data (including non-fault occurrences) is transmitted and stored in the train master unit 108.

In the embodiment provided, each wagon 120 comprises eight sensor modules 126 each comprising of data processing sub-modules 145 operably coupled there together with one sensor sub-module 140 and its respective data processing sub-module 145 disposed adjacent each of the eight wheels 123 of the wagon 120.

As shown in FIG. 4, each sensor module 126 comprises of a sub-module 140 including a ZigBee transceiver 141 for transmitting sensor data and/or alert signals to the ZigBee transceiver 141 on a wagon master module 125. On the sensor modules 126, there are two data storage units 142 and 147 also incorporated into the sensor sub-module 140 and 145 that again can store data with respect to a threshold level as well as historical data of the functioning of the respective sensors 151,153,155,157 operably coupled thereto. To this end, the sensor sub-module 140 includes an accelerometer 151, an acoustic sensor 153, such as a microphone, a force sensor 155, such as a strain gauge, and a temperature sensor 157, such as a thermocouple and/or infrared thermal detectors and may incorporate other sensors as required.

In the embodiment provided, the temperature sensors 157 of each sensor sub-module 140 is configured to monitor the temperature of both the wheel 123 and the bearing 124 of the wagon. With respect to the monitoring of wheels 123 infrared temperature sensors are used as appropriate. As will be appreciated, an increase or decrease in wheel temperature may indicate, for example, brake failure (i.e., failure of the brake to either engage or disengage from the wheel 123). For monitoring of bearing temperature, this can be achieved by thermocouple units.

The accelerometer 151 is configured to detect axial and/or radial accelerations and/or vibrations of the wheel axle assembly 128. In this manner, the accelerometer 151 generates sensor data that is transmitted to the data processing module 145 for analysis to derive there from bearing condition data corresponding to a degradation condition of the bearings 124 of the associated wheel axle assembly 128. Additionally, the accelerometer 151 can be capable of detecting the development of one or more flat portions on the wheel 123 associated therewith as well as track faults.

For the present embodiment, the force sensor 155 comprises of strain gauges that are configured to measure and/or detect a weight of the wagon 120, and hence whether the wagon 120 is overloaded or not. Additionally, the force sensors 155 can detect a partially dumped wagon as described herein as well as if the wagon 120 is unbalanced. Further to this, the force sensors 155 (i.e., a different physical sensor to the weight unit) is preferably adapted to determine braking forces as an indicator of brake integrity and maintenance. The information gained from these measurements may also be used to dynamically adjust on board control systems braking distance coefficients and minimise in train forces.

As part of the sensor module 126 the acoustic sensor 153 is preferably disposed adjacent the wheel axle assembly 128 so that the acoustic sensor 153 can detect any audio or sound emanating from the axle 122, the bearing 124 and/or the wheel 123 and transmits corresponding sensor data to the data processing module 145 for analysis thereby. Sensor data from the acoustic sensor 153 can be obtained over a period of time while the wagon 120 is in movement, so as to determine or indicate whether the wheel 123 has a flat portion and/or provide bearing condition data corresponding to a degree of degradation of the bearing 124 of the wheel 123. The acoustic sensors 153 can also be configured to detect damage or faults in an underlying portion of the railway track 102 as well as the detection of equipment dragging thereunder.

As illustrated in FIG. 4, the data processing module 145 includes a processor unit 146, such as a microprocessor or the like as are known in the art, During operation of the rail monitoring system 100, sensor data from each sensor module 126 collects data from the following sub-modules accelerometer 151, the acoustic sensor 153, the force sensor 155 and/or the temperature sensor 157 (as well as the output of any other sensors, such as geophones, accelerometers, acoustic sensors, ultrasonic sensors, electric field sensors, magnetic field sensors, light intensity sensors, light selective frequency sensors, humidity, angular rate sensors, Global Positioning System (GPS), mechanical shock, pressure, or fluid or gas flow rate sensors, video camera units, a pantograph monitoring system, an inclinometer and any combination thereof) is transmitted to the wagon master module 125 via a ZigBee carriage network 129. Prior to this, each sensor module 126 carries out pre-processing. (e.g., processor unit 146 of the data processing sub-module 145 for data conditioning, where the sensor data is amplified and/or filtered as appropriate). The data is then forwarded onto the train master unit 108 via the ZigBee backbone network 127.

In particular embodiments, sensor data is generated by the respective sensors 151,153,155,157 at a sampling or monitoring interval of less than 5 minutes, but is adjustable as required The rail infrastructure monitoring system 100 is also suitably configured to be dynamic, such that the monitoring interval can be automatically adjusted (e.g., shortened) if the sensor data suggests there is a sudden change in one or more performance indicators, such as a sudden increase in temperature detected by the temperature sensor 157 or a sudden increase in noise as detected by the acoustic sensor 153.

The various processor units (141, 136 or 146 or a sub-combination thereof) can then be configured to compare sensor data indicative of, for example, a wheel and/or bearing temperature, a flat wheel, an overweight wagon, an air pressure problem, an unbalanced load, a bearing failure (e.g., by the detection of increasing temperature and/or sound), a track fault (e.g., causes an impact on each wheel 123 as it passes over the particular track fault such that each wagon module 125 will generate the same alert signal with an identical GPS position, such that the track fault can be easily located and repaired) to a stored data value corresponding to the preselected threshold value thereof. If the sensor data is outside of this preselected threshold value, the processors then transmit an alert signal indicating a fault or imminent failure by the wagon ZigBee transceiver 141 over the intra wagon network to the wagon master ZigBee transceiver 136 and over the inter-wagon network 127 to the control unit 108 of the locomotive 110. By way of example, the alert signal can indicate to the operator of the locomotive 110 that the temperature of a particular bearing of a particular wheel 123 of a particular wagon 120 attached thereto is above a pre-selected threshold level. One of the processor unit thus triggers the alert signal when the temperature detected for its associated wheel exceeds a pre-selected threshold temperature.

Detection of one or more faults or defects and the generation of an alert signal by the sensor sub-module 140 of the sensor module 126 suitably relies on a number of different methods and/or algorithms, as are known in the art. By way of example, the sensor module 126 sub-module 140 monitors the condition of a bearing of the wheel 123 by assessing bearing and/or axle vibration using the accelerometer 151, the temperature of the bearing using the temperature sensor 157 and/or the acoustic signature thereof using the acoustic sensor 153. To this end, high bearing temperatures may be indicative of catastrophic bearing lubrication failure, whilst increased bearing vibration and/or acoustics can be indicative of various types of bearing defects of faults.

In addition to the above, the continuous monitoring of the sensor data by processor units or a train master unit 108 or server 170 as appropriate allows for a trending analysis at a respective wagon master sub-module 135, which can provide high reliability and accuracy with respect to the detection of faults. To this end, the various processor units can store at least partial data representative of historical peak levels in the sensor data at the first, second or third data storage units 138, 142, 147. If the wagon master processor unit then detects changes therein that exceed a pre-selected threshold trigger then an alert signal is generated and transmitted to the control unit 108. By way of example, the processor units can use the temperature sensor 157 to not only monitor absolute temperature of the wheel 123 in question but also calculates from its output a temperature rate of change. The wagon master processor unit then assesses or monitors the absolute temperature and temperature rate of change for any measurements outside of threshold levels based on short term analysis, longer term trending analysis is carried out in the server 170.

In particular embodiments, one or more modified wagon master modules known as alternative modules 131 include a video camera unit which allows for monitoring of the underside of the wagon including various things such as dragging equipment, though not limited to but including others such as track condition or switch blade condition etc.

In another embodiment an alternative module 131 consists of another variant of a wagon master module 125, and includes a video camera in addition to an air pressure sensor are disposed on the rearmost of wagon 120 of train 105. To this end the air pressure sensor (interfaced to sub-module 140) is configured to detect air pressure and transmit this to the train master unit 108 providing the driver with a continuous reading as previously described. This provides confirmation of train integrity continuously in conjunction with other integrity information such as train count, GPS train length etc giving the driver enhanced information.

In another variation of the embodiment described above, an alternative module 131 the rearmost wagon provides the ability to the driver to remotely vent the brake pipe in the case of emergency braking application.

In another variation the operator of the train can view video whilst in rear shunt mode whilst also providing:

i) warning audio buzzer for personnel; and ii) a way of visibly confirm shunt path clear.

Whilst in normal mode (non-shunt) the unit allows visual confirmation that a passing train is clear or the train is stabled clear of a passing loop marker board (e.g., track clearance marker) though not limited to these and other various other applications. This variant allows the transmission of picture frames via ZigBee communications.

In another variant/embodiment an alternative module 131 has an additional high-speed communications transceiver module such as LORA to provide live video to the train master unit 108 for display to the driver or a train control centre 170.

In some embodiments, the rail infrastructure monitoring system 100 further includes a train based and launched remote-controlled drone unit 115 (see FIG. 1.) The drone unit 115 can be utilised to, upon command from the driver or train control centre 170, self-launch autonomously to complete a mission and return to the train, allowing inspection and confirmation of an alert signal to the operator of the locomotive 110 and/or central control 170. In the case of a driverless train the drone unit 115 can be used to provide feedback to a train control centre 170 to verify safety procedures (via a visual inspection) prior to restarting the train (which removes the safety issue of a driver attending a remote location plus provides associated cost savings). The drone unit 115 can use LORA/mobile or other available communications to transmit (video and photographs) to a train master unit 108 with retransmission also available from the train to a train control centre 170. In other embodiments various other sensor and video technologies are also adaptable to the drone unit 115. Additionally, the sensor sub-module 140 can include a rotation rate sensor (not shown), such as a rate sensor or gyroscopic device, is oriented to generate sensor data indicative of the rotation of the wheel 123 and detect sliding or slipping thereof. The sensor sub-module 140 can include other detection sensors for the detection of train tilt (derailment via toppling due to high winds) in addition to track cant and measurement for track maintenance purposes.

Advantages of embodiments of the invention include a complete rail communication bearer as and when needed, hence replacing conventional systems of construction of a complete communications infrastructure system alongside the track.

The remaining FIGS. 7-9, 11 and 13 provide additional self-explanatory diagrams and schematics related to the description above.

Further advantages of some embodiments include the following:

- Providing a train brake force measurement system suitable for providing continuous input into an on board in-cab signalling system of braking distance, thus provide a more accurate calculation of individual train braking distances;
- Providing a complete new safety concept in terms of shunt alert and video technology;
- A system that is compatible with Driverless Trains;
- A system that is compatible with electronic controlled brake systems offering various enhancements e.g., providing an alternative monitoring and communication path if required;
- Dynamic feedback to driverless train onboard control systems to dynamically adjust braking distance for improved train transit times, as well as reduction of in train forces;
- Cross data integration, as compared to existing disparate systems, provides an integrated view of all monitored infrastructure (above and below rail) to the operator. Existing systems individually report back to a train control and the information must then be cross referenced between systems to achieve the best out of the various systems—giving the rail operator the task, either manually or by another IT system, all of which takes time, and also due to the possibility of missed reads may not be possible at all. For example, in the case of a flat wheel some embodiments of the present invention can detect the high impact of the fault and because it also measures the temperature of the same wheel the corresponding increase in temperature of the wheel due to the flat wheel is able to be quickly linked together by way of this system and the train driver alerted quickly to the high probability fault due to two confirming and thus redundant fault indicators;
- Utilization of self-learning, predictive analysis and machine learning. For example, if an embodiment is fitted to a new item of rolling stock such as an ore car/freight wagon, it provides lifecycle performance which can be easily compared with other cars the same age in the fleet, and also allow predictions and probability analysis as well as future automated decision making;
- Improved productivity. The system offers the rail operator a competitive edge that does not become obsolete after a few years, as the system is flexible enough to incorporate additional features over time. Firmware updates can be carried out without taking rolling stock/infrastructure out of service;
- Real Time Derailment detection;
- Dangerous goods and Freight monitoring in real time;
- Self-diagnostics allowing simple change out of modules with regular remote firmware updates;
- Physical and encryption security;
- Level crossing monitoring.

Those skilled in the art will appreciate that not all of the advantages described herein are incorporated into all embodiments of the present invention.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

The invention claimed is:

1. A rail infrastructure monitoring system comprising;

a control unit;

a plurality of wagon master modules;

a plurality of sensor modules configured to communicate wirelessly with a wagon master module, wherein each sensor module is associated with a respective wagon of a train on a track, each sensor module including one or more sensors, the sensor modules comprising:

a processor; and one or a plurality of sensors adapted to measure one or more sensor data values indicative of a condition of a portion of the track infrastructure and/or the wagon, the sensors further adapted for inputting the sensor data values to the processor; and a train master unit;

wherein the processor is adapted to determine whether the measured sensor data values from the sensors is within a threshold range thereof and respond to a determination that the measured sensor data values are outside the threshold range by generating and sending an alert signal to a wagon master module, and wherein the wagon master module sends the alert signal to the train master unit.

2. The system of claim 1, wherein the wagon master modules each include a unique identification address unit configured to associate the sensor data values with an identification number of the wagon or below rail infrastructure associated with a sensor module.

3. The system of claim 1, wherein the sensors provide real-time and/or at least semi-continuous measurement of the sensor data values to the processor.

4. The system of claim 1, wherein the sensor and master modules each have a ZigBee transceiver and communicate with each other and the control unit using wireless communications according to a ZigBee protocol or other wireless technology.

5. The system of claim 1, wherein the one or plurality of sensors is selected from the group consisting of a temperature sensor, an accelerometer, a gyroscope sensor, a voltage sensor, a current sensor, a visual sensor (camera or video), an acoustic sensor, an input output sensor, an air pressure sensor, an impact sensor, a hall effect sensor, a light sensor, a weather (wind, rain, water level, solar irradiation) sensor, a proximity sensor, a fluid level sensor, a slope sensor, a location sensor, a dust sensor, a force sensor and any combination thereof.

6. The system of claim 1, wherein the one or plurality of sensors are operatively associated with a respective wheel axle assembly of the wagon.

7. The system of claim 1, wherein the sensor data value is selected from the group consisting of a wheel temperature value, a brake block missing, a brake shoe wear outside limits, a dust value, a handbrake position, a Chute/Wagon cover position, a spring fault, a suspension range, a coupler force, slack value, a hunt detection, a brake air pressure, a train integrity status, an axle vibration value, a bearing vibration value, a wagon weight, an acoustic signature and any combination thereof.

8. The system of claim 1, wherein the sensor data values are indicative of one or more of a degree of degradation of a bearing of a wheel, a flat portion on a wheel, a brake condition, an overloaded wagon, an unevenly loaded wagon and wheel hunting.

9. The system of claim 1, wherein the wagon master modules each include a GPS unit and the sensor data values identifying a respective location, speed, direction, recording time (GMT), date of each of the sensor modules.

10. The system of claim 1, wherein the wagon master modules are configured to communicate with the control unit directly or by communicating through adjacent wagon master modules as intermediary communication links.

11. The system of claim 1, wherein the control unit and/or the wagon master sensor modules are capable of receiving and/or processing one or more external signals from a below rail detection device.

12. The system of claim 1, further comprising a data transmitter for transmitting the sensor data values and/or the alert signals for all or at a least a portion of the sensor modules to a control centre and/or an operator remote from the train, and wherein in the case of partial readings when the train returns to high speed communication range or reaches the end of a journey any missing values are automatically downloaded to the control centre.

13. A system for application to a wagon of a train on a track or below rail infrastructure, the system comprising:

a transceiver configured to communicate wirelessly with a control unit;

one or more sensor modules; the sensor modules comprising:

a processor; and one or a plurality of sensors adapted to measure one or more sensor data values indicative of a condition of a portion of the track infrastructure and/or the wagon, the sensors further adapted for inputting the sensor data values to the processor;

wherein the processor is adapted to determine whether the measured sensor data values from the sensors is within a threshold range thereof and respond to a determination that the measured sensor data values are outside the threshold range by generating and sending an alert signal to the control unit.

14. The system of claim 13, further comprising a wagon master module having a unique identification address unit configured to associate the sensor data values with an identification number of the wagon or below rail infrastructure associated with a sensor module.

15. The system of claim 13, wherein the sensors provide real-time and/or at least semi-continuous measurement of the sensor data values to the processor.

16. The system of claim 13, wherein the sensor modules each have a ZigBee transceiver and communicate with the wagon master module to the control unit using wireless communications according to a ZigBee protocol, or other wireless technology.

17. The system of claim 13, wherein the one or plurality of sensors is selected from the group consisting of a temperature sensor, an accelerometer, a gyroscope sensor, a voltage sensor, a current sensor, a visual sensor (camera or video), an acoustic sensor, an input output sensor, an air pressure sensor, an impact sensor, a hall effect sensor, a light sensor, a weather (wind, rain, water level, solar irradiation)

sensor, a proximity sensor, a fluid level sensor, a slope sensor, a location sensor, a dust sensor, an acoustic sensor, a force sensor and any combination thereof.

18. The system of claim 13, wherein the one or plurality of sensors are to be operatively associated with a respective wheel axle assembly of the wagon.

19. The system of claim 13, wherein the sensor data value is selected from the group consisting of a wheel temperature value, an axle vibration value, a bearing vibration value, a wagon weight, a brake block missing, a brake shoe wear outside limits, a dust value, a handbrake position, a Chute/Wagon cover position, a spring fault, a suspension range, a coupler force, slack value, a hunt detection, a brake air pressure, a train integrity status, a switch machine status, a bridge monitor, a track lubricator status, dangerous goods status, weather value, an acoustic signature and any combination thereof.

20. The system of claim 13, wherein the sensor data values are indicative of one or more of a degree of degradation of a bearing of a wheel, a flat portion on a wheel, a brake condition, an overloaded wagon, an unevenly loaded wagon and wagon hunting.

21. The system of claim 13, further including a GPS unit and the sensor data values identifying a respective location, speed, direction, recording time (GMT), date of a sensor module.

22. The system of claim 13, wherein the wagon master module is configured to communicate with the control unit directly or by communicating through adjacent wagon master modules as intermediary communication links.

23. The system of claim 13, wherein a wagon master and sensor module is capable of receiving and/or processing one or more external signals from a below rail detection device, or wherein a train master unit is capable of receiving and/or processing one or more external signals directly from a below rail detection device.

24. A method for monitoring a wagon of a train on a track or below rail infrastructure, said method including the steps of:

providing a control unit and a wagon master module and a sensor module, wherein the sensor module comprises a transceiver configured to communicate wirelessly with the wagon master module and one or more sensor modules communicating with the wagon master module, the sensor modules comprising a processor and one or a plurality of sensors;

measuring by the one or plurality of sensors one or more sensor data values indicative of a condition of a portion of the track infrastructure and/or the wagon;

inputting the sensor data values to the processor;

determining by the processor whether the measured sensor data values from the sensors is within a threshold range thereof; and generating and sending an alert signal to the wagon master module if the processor determines that the measured sensor data values are outside the threshold range and further including the step of receiving and/or processing one or more external signals from a below rail detection device.

25. The method of claim 24, wherein the train master unit is associated with a locomotive of the train.

26. The method of claim 24, further including the step of receiving and/or processing one or more external signals from a below rail detection device.

27. The method of claim 24, further including the step of associating the sensor data values with an identification number of the wagon or below rail infrastructure associated with the sensor module.

28. The method of claim 24, further including the step of transmitting the sensor data values and/or the alert signals for all or at least a portion of the sensor modules to a control centre and/or an operator remote from the train.

29. The method of claim 24, wherein the processor generates an alert signal if the and sensor data values are above or below the threshold level.

30. The method of claim 24, wherein the wagon master and sensor module is:

a rail infrastructure monitoring system comprising;

a control unit;

a plurality of wagon master modules;

a plurality of sensor modules configured to communicate wirelessly with a wagon master module, wherein each sensor module is associated with a respective wagon of a train on a track, each sensor module including one or more sensors, the sensor modules comprising:

a processor; and one or a plurality of sensors adapted to measure one or more sensor data values indicative of a condition of a portion of the track infrastructure and/or the wagon, the sensors further adapted for inputting the sensor data values to the processor; and a train master unit;

wherein the processor is adapted to determine whether the measured sensor data values from the sensors is within a threshold range thereof and respond to a determination that the measured sensor data values are outside the threshold range by generating and sending an alert signal to a wagon master module, and wherein the wagon master module sends the alert signal to the train master unit; and wherein the control unit and/or the wagon master sensor modules are capable of receiving and/or processing one or more external signals from a below rail detection device.

31. The system of claim 1 being further characterised in that:

a. the one or plurality of sensors includes at least a temperature sensor, an accelerometer, a gyroscope sensor, a voltage sensor, a current sensor, a visual sensor, an acoustic sensor, an input output sensor, an air pressure sensor, a hall effect sensor, a weather sensor, a proximity sensor, a fluid level sensor, a slope sensor, a GPS location sensor, and a dust sensor;

b. further comprising a data transmitter for transmitting the sensor data values and/or the alert signals for all or at a least a portion of the sensor modules to a control centre and/or an operator remote from the train, and wherein in the case of partial readings when the train returns to high speed communication range or reaches the end of a journey any missing values are automatically downloaded to the control centre; and c. further including the step of receiving and/or processing one or more external signals from a below rail detection device.

* * * * *